United States Patent [19]

Furr

[11] Patent Number: 4,490,312

[45] Date of Patent: Dec. 25, 1984

[54] COOLING TOWER WITH INTERLOCKING TILES

[75] Inventor: Dale D. Furr, Arlington, Tex.

[73] Assignee: Ceramic Cooling Tower Company, Fort Worth, Tex.

[21] Appl. No.: 409,541

[22] Filed: Aug. 19, 1982

[51] Int. Cl.[3] ..... B01F 3/04

[52] U.S. Cl. ..... 261/98; 261/DIG. 11; 261/DIG. 72

[58] Field of Search ..... 261/DIG. 72, 98, DIG. 11

[56] References Cited

U.S. PATENT DOCUMENTS

| | | | |
|---|---|---|---|
| 308,577 | 11/1884 | Richards | 261/DIG. 72 |
| 556,040 | 3/1896 | Alberger | 261/DIG. 72 |
| 1,173,187 | 2/1916 | Hechenbleikner | 261/DIG. 72 |
| 1,307,635 | 6/1919 | Nielsen | 261/DIG. 72 |
| 1,947,777 | 2/1934 | Huff et al. | 261/DIG. 72 |
| 2,571,958 | 10/1951 | Slaughter et al. | 261/DIG. 72 |
| 2,911,204 | 11/1959 | Malone | 261/DIG. 72 |
| 4,129,627 | 12/1978 | Furr | 261/DIG. 72 |
| 4,382,046 | 5/1983 | Frohwerk | 261/DIG. 72 |

FOREIGN PATENT DOCUMENTS

| | | | |
|---|---|---|---|
| 2498080 | 7/1982 | France | 261/DIG. 72 |
| 53-11171 | 2/1978 | Japan | 261/DIG. 72 |

*Primary Examiner*—Tim R. Miles

[57] ABSTRACT

A cooling tower includes a heat and mass transfer section which is formed by layers of interlocked open-celled tiles. Each tile includes a pair of corner projections and a pair of recessed portions, and the corner projections of each tile fit into and are interlocked with the recessed portions of adjacent tiles.

7 Claims, 12 Drawing Figures

COOLING TOWER WITH INTERLOCKING TILES

BACKGROUND AND SUMMARY

This invention relates to cooling towers, and, more particularly, to a cooling tower having a heat and mass transfer section which is formed from interlocked open-celled tiles.

Cooling towers are used to cool liquid for many applications, for example, for air conditioning systems, nuclear power plants, etc. It is desirable that cooling towers, particularly cooling towers which are used in nuclear power plants, be resistant to earthquakes and tremors so that the cooling tower will continue to provide efficient cooling during and after an earthquake.

U.S. Pat. No. 4,129,627 describes a cooling tower which is protected from airborne missiles during tornadoes. The heat and mass transfer section of this cooling tower is provided by layers of open-celled tiles. Each layer of tiles is supported by the next lower level, and the tiles of each layer are preferably spaced from each other to facilitate efficient heat and mass transfer as liquid falls downwardly through the layers of tiles and air is drawn upwardly through the tiles. While this cooling tower is protected from tornadoes, a high level excitation earthquake can cause the tiles to be rearranged so that the efficiency of the cooling tower may be reduced.

The invention utilizes interlocking tiles which are resistant to lateral shifting or movement during earthquakes. Each tile includes two corner projections and two recessed portions, and the corner projections of each tile fit into an interlock with the recessed portions of two adjacent tiles. The tiles of each layer are confined by the side wall of the cooling tower, and the side wall and the interlocking of the tiles prevent the tiles from shifting. The cells of the tiles are provided by intersecting partitions, and the tiles provide optimum heat and mass transfer when the intersections of each tile are centered over the cells of the tiles immediately below. The optimum relationship is maintained during earthquakes by the interlocked tiles.

DESCRIPTION OF THE DRAWING

The invention will be explained in conjunction with an illustrative embodiment shown in the accompanying drawing, in which—

DESCRIPTION OF SPECIFIC EMBODIMENT

Figure 1:
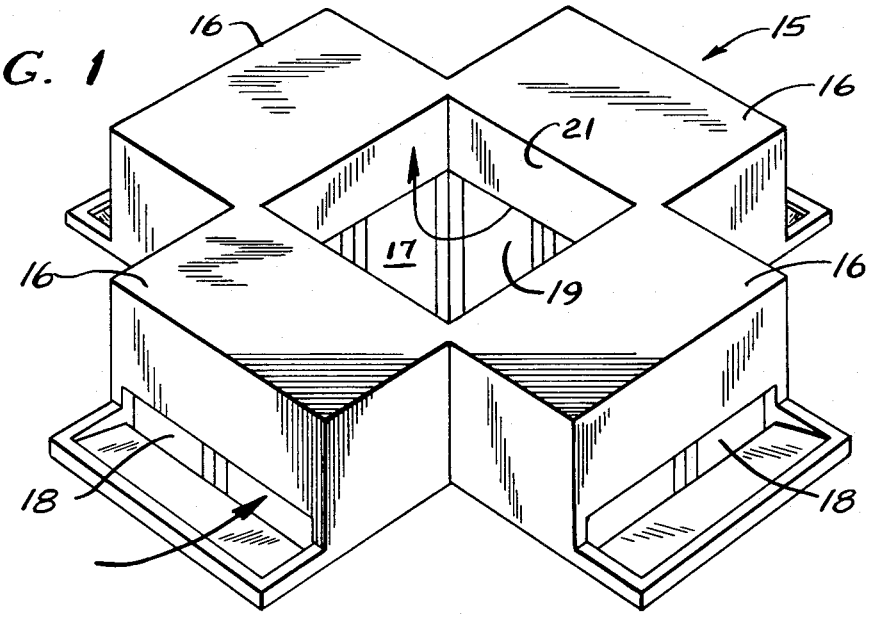
FIG. 1 is a perspective view of a tornado protected cooling tower which is described in U.S. Pat. No. 4,129,627.

The invention will be explained in conjunction with the tornado protected tower 15 illustrated in FIGS. 1 and 2. The tornado protected tower is particularly advantageous for nuclear power plants because of safety regulations of the United States Nuclear Regulatory Commission which requires cooling towers to be protected from horizontally and vertically generated missiles. It is also advantageous that a cooling tower for a nuclear power plant continue to operate efficiently during and after an earthquake. It will be understood, however, that the invention is suitable for cooling towers which are used in other environments, for example, air conditioning systems and the like.

The details of the cooling tower 15 are described in U.S. Pat. No. 4,129,627, and the description of that patent is incorporated herein by reference. The cooling tower includes a plurality of enclosed cooling cells 16 which discharge air to a common area 17. Each of the cells 16 includes a cool air inlet 18 and a warm air outlet 19. A plurality of fans 20 (FIG. 2) are mounted within each of the cells along the side 21 thereof adjacent the central opening 17.

Each cell includes a heat and mass transfer section 22 (FIGS. 2 and 3) which is formed by layers of open-celled tiles as will be explained more fully hereinafter. A liquid distribution assembly 23 is supported above the heat and mass transfer section for supplying liquid which is to be cooled to the heat and mass transfer section. The liquid distribution assembly includes a large manifold pipe 24 and smaller lateral pipes 25 which extend perpendicularly from the manifold. Spray nozzles are located along each lateral pipe for spraying the liquid. The fans 20 draw air upwardly through the layer of open-celled tiles as the liquid falls downwardly through the tiles, and the heat and mass transfer between the air and the liquid cools the liquid. The cooled water is collected at the bottom of the tower.

Figure 4:
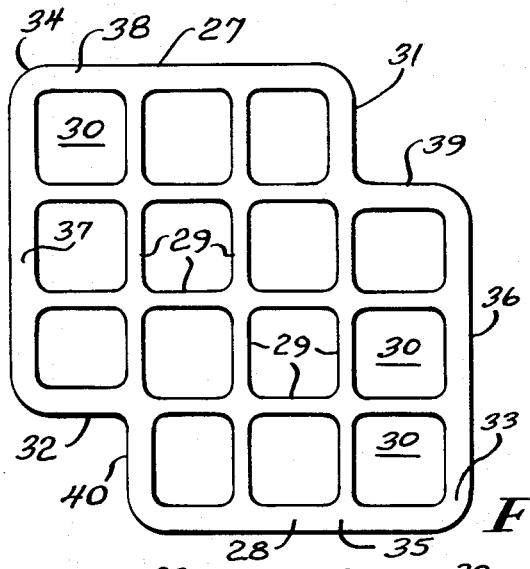
FIG. 4 is a plan view of one of the interlocking tiles which form the heat and mass transfer section.
Figure 5:
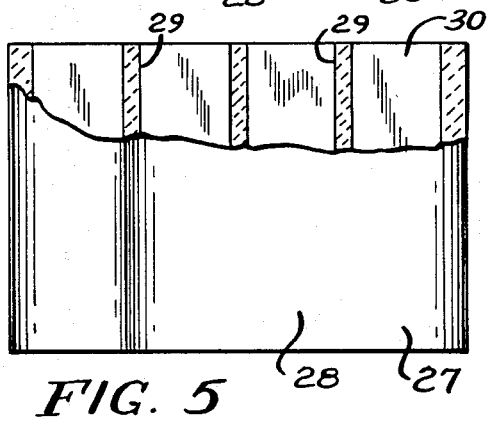
FIG. 5 is an elevational view, partially broken away, of the interlocking tile.

Referring now to FIGS. 4 and 5, the heat and mass transfer section is formed by stacked layers of tiles 27. Each tile includes a vertically extending side wall 28 and a plurality of intersecting partitions or inner walls 29 which form a plurality of vertically extending open cells 30. Each tile has a pair of recessed portions 31 and 32 in the side wall and a pair of corners 33 and 34. The side wall 28 includes two perpendicular side wall portions 35 and 36 which meet to form the corner 33 and two perpendicular side wall portions 37 and 38 which meet to form the corner 34. Two L-shaped side wall portions 39 and 40 join the side wall portions 36 and 38 and 35 and 37, respectively, to form the recesses 31 and 32.

In the particular embodiment illustrated in FIGS. 4 and 5, the length of the side wall portions 35–38 and the number of partitions 29 are such that each of the side wall portions extends along three cells 30. Each leg of the L-shaped wall portions 39 and 40 extends along one cell.

Figure 8:
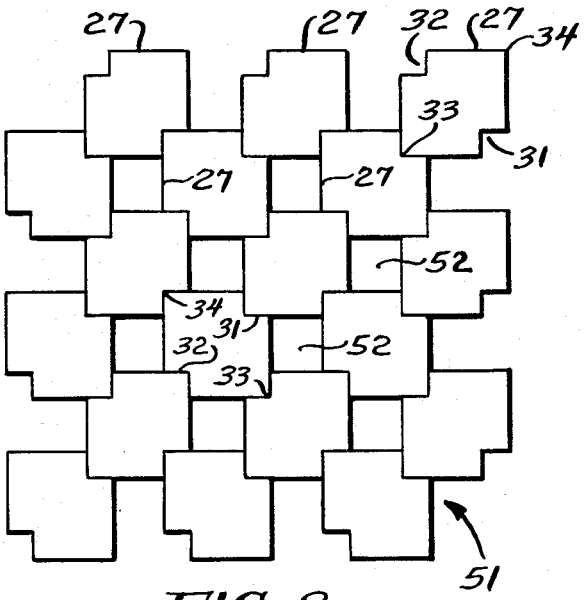
FIG. 8 is a plan view showing the outlines of one of the layers of interlocking tiles.

The shape of each of the recesses 31 and 32 corresponds with the shape of the corners 33 and 34. Accordingly, a plurality of tiles 27 can be interfitted and interlocked as shown in FIG. 8 by inserting each corner of each tile into a recess of another tile.

Figure 6:
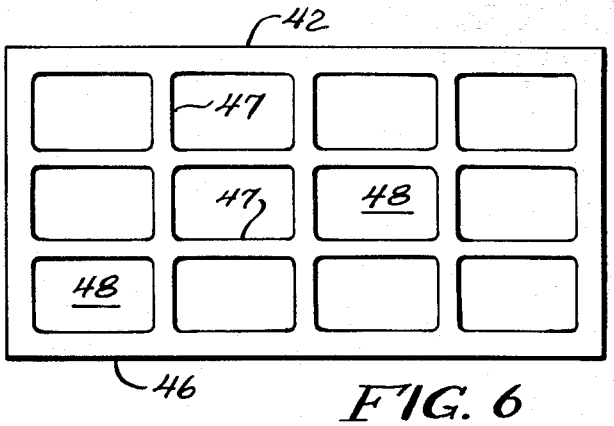
FIG. 6 is a plan view of one of the tiles of the bottom layer of tiles.
Figure 7:
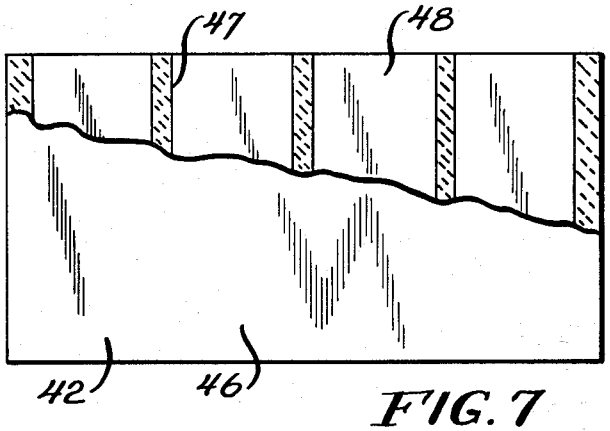
FIG. 7 is an elevational view, partially broken away of one of the tiles of the bottom layer.
Figure 10:
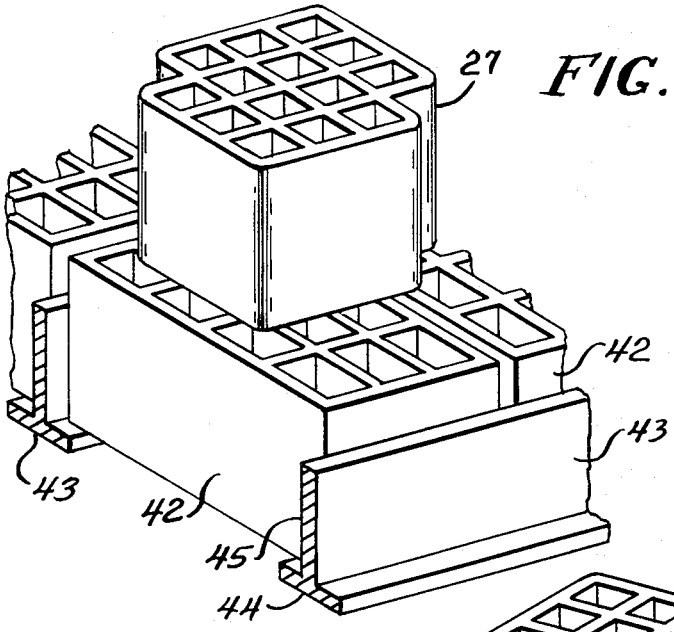
FIG. 10 is a fragmentary perspective view of the first two layer of tiles.

The tiles which form the first layer of the heat and mass transfer section are advantageously rectangular as shown in FIGS. 6 and 7. The rectangular tiles 42 are easily supported by cast iron lintels 43 (FIG. 10). Each lintel has an inverted T-shape formed by a cross portion 44 and an upright portion 45, and a pair of lintels support the ends of each of the tiles of the first layer. The lintels are supported by beams or ledges within the cooling tower as described in U.S. Pat. No. 4,129,627. Each of the rectangular tiles 42 includes a vertical side wall 46 and a plurality of intersecting partitions 47 which form rectangular cells 48. In the embodiment illustrated the rectangular tiles have four cells along their length and three cells along their width.

Figure 2:
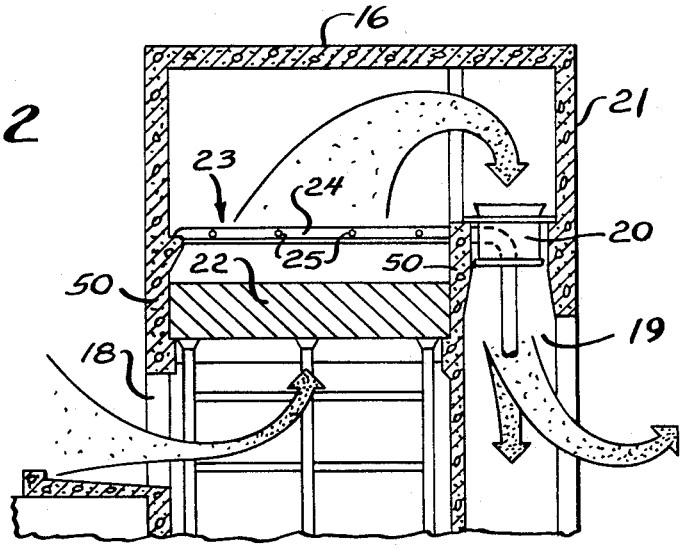
FIG. 2 is a fragmentary cross sectional view of the cooling tower.
Figure 3:
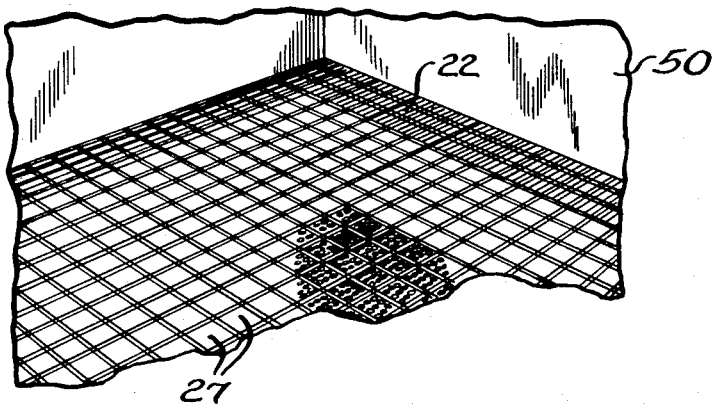
FIG. 3 is a fragmentary perspective view of the heat and mass transfer section of the tower.

Referring to FIGS. 2 and 3, the heat and mass transfer section is enclosed or surrounded by a side wall 50. The particular side wall illustrated is rectangular, but other shapes can also be used, for example, round or other polygons. The first layer of rectangular tiles 42 are supported by the lintels 43 as shown in FIG. 10. Adjacent rectangular tiles are spaced apart to facilitate passage of air and liquid therebetween, and the tiles of the first layer extends right up to the side wall 50 of the cooling tower. If necessary, tiles can be broken into smaller pieces in order to fill spaces between a whole tile and the side wall.

Figure 11:
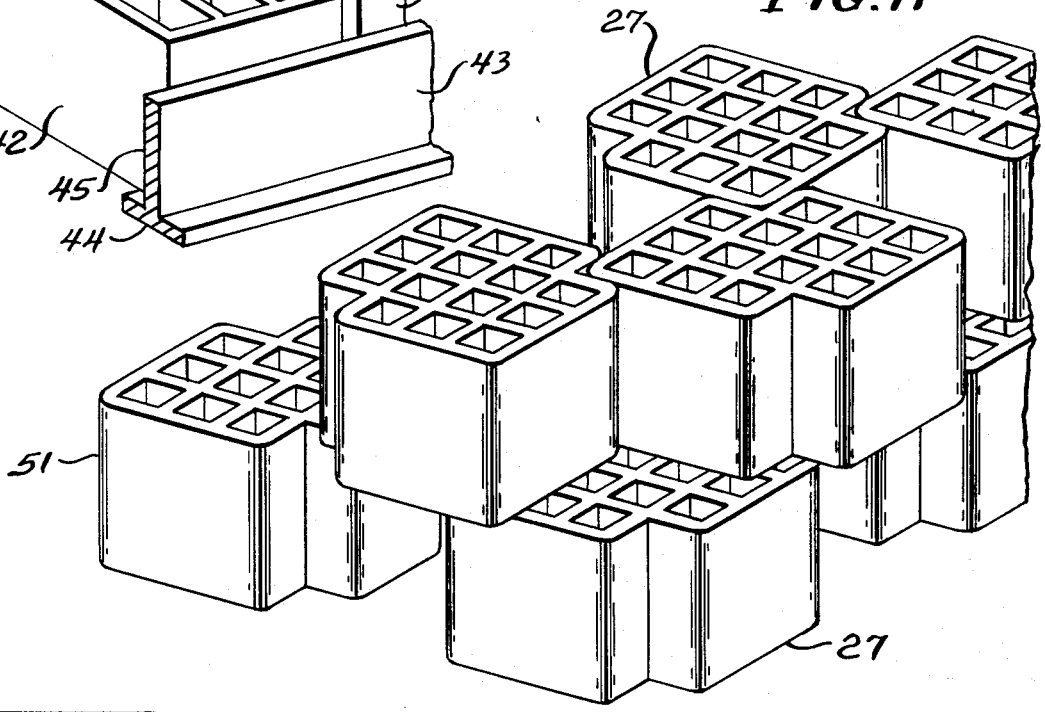
FIG. 11 is a fragmentary perspective view of two adjacent layers of interlocking tiles.
Figure 12:
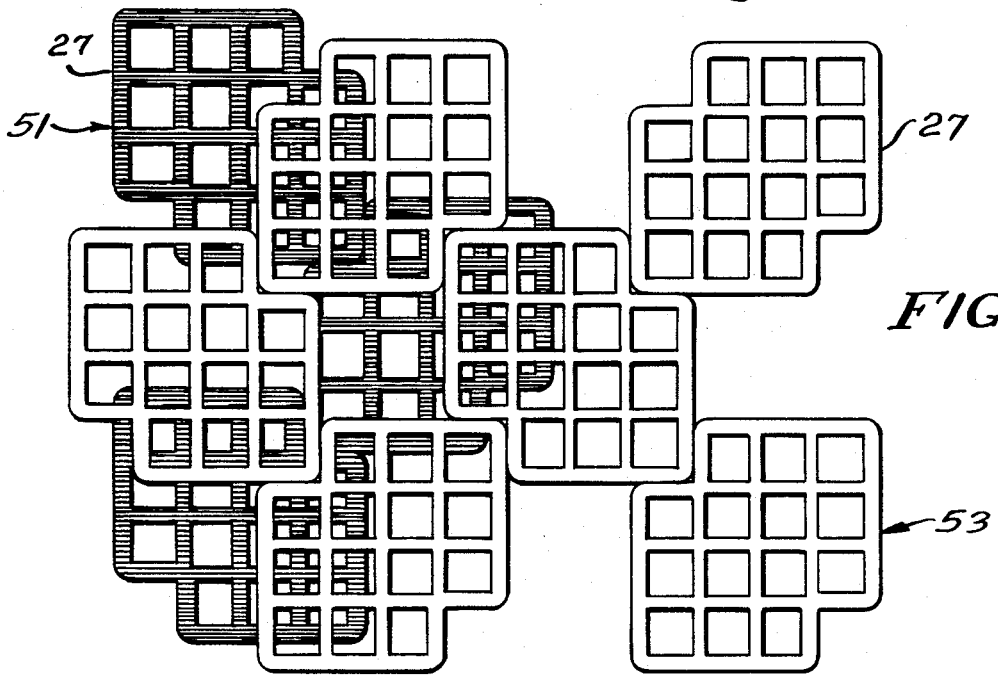
FIG. 12 is a fragmentary plan view of two adjacent layers of interlocking tiles.

After the first layer of rectangular tiles, the remainder of the heat and mass transfer section is formed by stacking layers of the interlocking tiles 27. The first layer 51 of interlocking tiles is illustrated in FIGS. 8, 11, and 12. The tiles are arranged in parallel rows, and adjacent tiles of each row are separated by a square opening 52, (FIG. 8) the sides of which corresponds to three cells 30. The interlocking tiles are also laid so that they extend up to and are confined by the side wall 50. The tiles can be broken along one of the partitions 29 in order to form a smaller tile which can fill any space which remains between a whole tile and the side wall 50.

Figure 9:
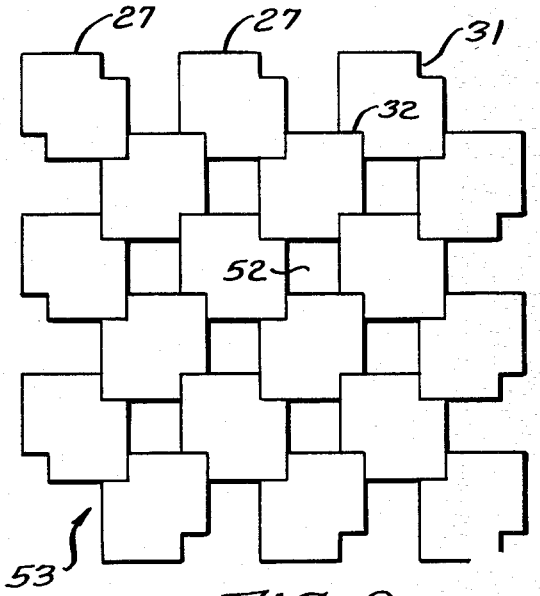
FIG. 9 is a plan view showing the outlines of a layer of interlocking tiles which is above or below the layer of FIG. 8.

The second layer 53 of interlocking tiles is illustrated in FIGS. 9, 11, and 12. The tiles of the second layer are advantageously arranged so that the intersections of the partitions of the tiles in the second layer 53 are substantially centered over the cells of the tiles in the first layer 52. Some of the intersections of the tiles of the second layer will overlie the openings 52 between the tiles of the first layer and will prevent a "chimney" effect in which air and liquid move vertically without interruption. The tiles of the second layer are also confined by the side wall 50 of the cooling tower, and any spaces between whole tiles and the side wall can be filled by breaking whole tiles into smaller pieces.

The remaining layers of interlocking tiles are stacked in a similar manner so that the intersections of the partitions of one layer will be substantially aligned with the centers of the cells of the layers above and below. For example, the third layer will correspond to the layer 51 illustrated in FIG. 8, the fourth layer will correspond to the layer 53 in FIG. 9, the fifth layer will correspond to the layer 51 illustrated in FIG. 8, etc.

The liquid which is sprayed over the top layer of tiles flows downwardly through the cells of the tiles and the spaces between adjacent tiles, and the air which is drawn through the cooling tower by the fans passes upwardly through these cells and spaces. The countercurrent flow of liquid and air effects heat and mass transfer between the liquid and air.

FIG. 8 illustrates only a portion of one of the layers of tile. The entire layer would have more tiles, and the periphery of the layer would be confined by the side wall 50 of the cooling tower. It will be appreciated from FIG. 8 that the interlocking of the tiles and the confinement by the side wall prevent the tiles from shifting laterally or horizontally (i.e., in the plane of the drawing) in any direction. Similarly, the tiles of the next layer illustrated in FIG. 9 are prevented from shifting, and the optimum relationship between the tiles of adjacent layers will be retained.

The corner projections and the recessed portions have side dimensions corresponding to only one of the cells. The interlocking of the tiles is thereby accomplished by contact between the side walls of adjacent tiles which is limited to the length of two sides of a cell. The remainder of the side wall of each tower is spaced from adjacent tiles to increase the efficiency of the heat and mass transfer. It will be understood that the rectangular tiles described in U.S. Pat. No. 4,129,627 could be confined against shifting during an earthquake by arranging the tiles so that each tile abutted the four adjacent tiles. However, this would eliminate the spaces between adjacent tiles and would adversely effect the efficiency of the cooling tower.

The interlocking tiles and the rectangular tiles are formed by extruding clay to form a tube having the desired cross-section and the axially extending cells. The extruded tube is transversely severed by cutting wires to form individual tiles having the desired axial length. Thereafter, the tiles are hardburned to form a hard, structural tile having low water absorbance. In one specific embodiment the interlocking tiles 27 had an axial dimension or height of 6". The length of the side wall portions 35–38 was about 6-23/32", and the length of each leg of the L-shaped side wall portions 39 and 40 was 2-9/32". The overall dimension of each side was therefore 9". The cells 30 were 1-27/32× 1- 27/32". The axial dimension of the rectangular tiles 42 was 6", and the side dimensions were about 12-1/32×6". The cells 48 were 2½×1-7/16".

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. In a cooling tower having a side wall providing a cooling enclosure, tile support means within said enclosure for supporting a plurality of open-celled tiles, and liquid distribution means for supplying liquid to be cooled to said enclosure, the improvement comprising a plurality of layers of open-celled tiles stacked above the tile support means and supported thereby, each of said tiles including a side wall which extends around the tile and a plurality of intersecting partitions inside the side wall which provide a plurality of generally rectangular cells, the side wall providing a first corner around two sides of a first cell and a second corner around two sides of a second cell, the side wall extending inwardly along two sides of a third cell to provide a first recessed portion and extending inwardly along two sides of a fourth cell to provide a second recessed portion, the recessed portions and the corners being complementarily shaped so that each projecting portion of one tile can be inserted into a recessed portion of an adjacent tile whereby the tiles of each of said layers are interlocked and lateral relative movement of the tiles is restrained.

2. The structure of claim 1 including a first layer of generally rectangular tiles supported by the tile support means, said plurality of layers of tiles being supported by the first layer of rectangular tiles.

3. The structure of claim 1 in which the outer tiles of each layer are adjacent to and confined by the side wall of the tower whereby lateral outward movement of the tiles is prevented.

4. The structure of claim 1 in which the intersections of the partitions of the tiles of each of said layers are positioned over cells of the next lower layer of tiles.

5. The structure of claim 1 in which the tiles of each of said layers are arranged in parallel rows, each tile in a row being spaced from the adjacent tiles in the row by a distance corresponding to two cells.

6. The structure of claim 1 in which each tile has two pairs of straight side wall portions and two L-shaped recessed portions, the straight side wall portions of each pair extending perpendicularly to each other to form one of said corners, each of said L-shaped recessed portions joining a straight side wall portion of one of said pairs of a straight side wall portion of the other of said pairs.

7. The structure of claim 6 in which the length of each straight side wall portion corresponds to three cells and each L-shaped portion comprises a pair of perpendicular walls having a length which corresponds to one cell.

* * * * *